US010049829B2

(12) United States Patent
Tanaka

(10) Patent No.: US 10,049,829 B2
(45) Date of Patent: Aug. 14, 2018

(54) SWITCH DEVICE

(71) Applicant: ALPS ELECTRIC CO., LTD., Tokyo (JP)

(72) Inventor: Takaki Tanaka, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/403,840

(22) Filed: Jan. 11, 2017

(65) Prior Publication Data

US 2017/0207037 A1 Jul. 20, 2017

(30) Foreign Application Priority Data

Jan. 18, 2016 (JP) ..... 2016-007270

(51) Int. Cl.

| | |
|---|---|
| ***H01H 3/02*** | (2006.01) |
| ***H01H 3/32*** | (2006.01) |
| ***H01H 3/12*** | (2006.01) |
| ***H01H 9/04*** | (2006.01) |
| ***H01H 13/52*** | (2006.01) |

(52) U.S. Cl.

CPC ..... *H01H 3/32* (2013.01); *H01H 3/12* (2013.01); *H01H 9/04* (2013.01); *H01H 13/52* (2013.01); *H01H 2003/326* (2013.01)

(58) Field of Classification Search

CPC H01H 3/32; H01H 13/52; H01H 3/12; H01H 9/04; H01H 2003/326

USPC ..... 200/520, 529, 341, 343, 339, 553, 558, 200/302.3

See application file for complete search history.

(56) References Cited

U.S. PATENT DOCUMENTS

| | | | | |
|---|---|---|---|---|
| 4,145,588 A * | 3/1979 | Orcutt | ..... | H01H 35/343 200/302.1 |
| 4,843,195 A * | 6/1989 | Sato | ..... | H01H 23/065 200/302.3 |
| 2012/0111709 A1* | 5/2012 | Senzaki | ..... | G07C 9/00944 200/5 A |

FOREIGN PATENT DOCUMENTS

JP H02-257532 A 10/1990

* cited by examiner

*Primary Examiner* — Edwin A. Leon
*Assistant Examiner* — Lheiren Mae A Caroc
(74) *Attorney, Agent, or Firm* — Brinks Gilson & Lione

(57) ABSTRACT

A switch device includes a casing that includes a recessed bearing portion, a rotatable drive member that includes a shaft portion disposed in the bearing portion, a switch driven by the drive member, and a covering member that includes a pressing structure provided so as to press an upper portion of the shaft portion and that is secured to the casing. The covering member includes an operating portion that faces the drive member such that the operating portion is able to press the drive member and that is formed of an elastically deformable elastic material and a base portion that is secured to the casing, that is formed of a synthetic resin material, and that is integrated with the operating portion. The pressing structure is integrated with the base portion and formed of an elastically deformable elastic material.

12 Claims, 11 Drawing Sheets

SWITCH DEVICE

CLAIM OF PRIORITY

This application claims benefit of priority to Japanese Patent Application No. 2016-007270 filed on Jan. 18, 2016, which is hereby incorporated by reference in its entirety.

BACKGROUND

1. Field of the Disclosure

The present disclosure relates to switch devices, and in particular, relates a switch device in which play in an operating portion is suppressed.

2. Description of the Related Art

Examples of related-art switch devices used for a variety of electronic apparatus include switch devices in which play in an operating portion is suppressed. An operating device 900 described in Japanese Unexamined Patent Application Publication No. 2-257532 is known as one of such related-art switch devices. This operating device 900 is described with reference to FIG. 12.

In the operating device 900, a switch main body 902 is housed in and secured to a casing 901 that includes a cover 913 and a base 911 formed of a synthetic resin material, and an operating lever 903 for operating the switch main body 902 is also housed in the casing 901. A shaft portion 930 is formed on one end side of this operating lever 903. A push button portion 932 and an operating portion 931 are formed on the other end side of this operating lever 903. The push button portion 932 projects to the outside of the cover 913 through a hole 914 of the cover 913. The operating portion 931 abuts the switch main body 902 so as to operate the switch main body 902. Furthermore, a bearing portion 945 is formed between a support 905 provided on the base 911 side and a support 904 provided on the cover 913 side. The shaft portion 930 is rotatably held by the bearing portion 945. Furthermore, a thin portion 941 is formed at a bottom portion of the support 904 on the cover 913 side. The thickness of the thin portion 941 is smaller than the thickness of part of the cover 913 other than the thin portion 941.

With the above-described structure, even when accuracy in shape and assembly of the cover 913 varies, this variation is absorbed by the thin portion 941. Thus, play in the operating lever 903 is suppressed, and as a result, the operating lever 903 is smoothly moved.

In a switch device such as an operating device 900, the bottom portion of the support 904 of the cover 913 formed of a synthetic resin material serves as the thin portion 941 having a small thickness. Thus, when a strong force acts on the operating lever 903 or part of the cover 913 near the operating lever 903, the thin portion 941 may be damaged.

SUMMARY

A switch device according to an aspect of the present invention includes a casing that includes a recessed bearing portion, a rotatable drive member that includes a shaft portion disposed in the bearing portion, a switch driven by the drive member, and a covering member that includes a pressing structure provided so as to press an upper portion of the shaft portion and that is secured to the casing. The covering member includes an operating portion that faces the drive member such that the operating portion is able to press the drive member and that is formed of an elastically deformable elastic material and a base portion that is secured to the casing, that is formed of a synthetic resin material, and that is integrated with the operating portion. The pressing structure is integrated with the base portion and formed of an elastically deformable elastic material.

DESCRIPTION OF THE EXEMPLARY EMBODIMENTS

Figure 1:
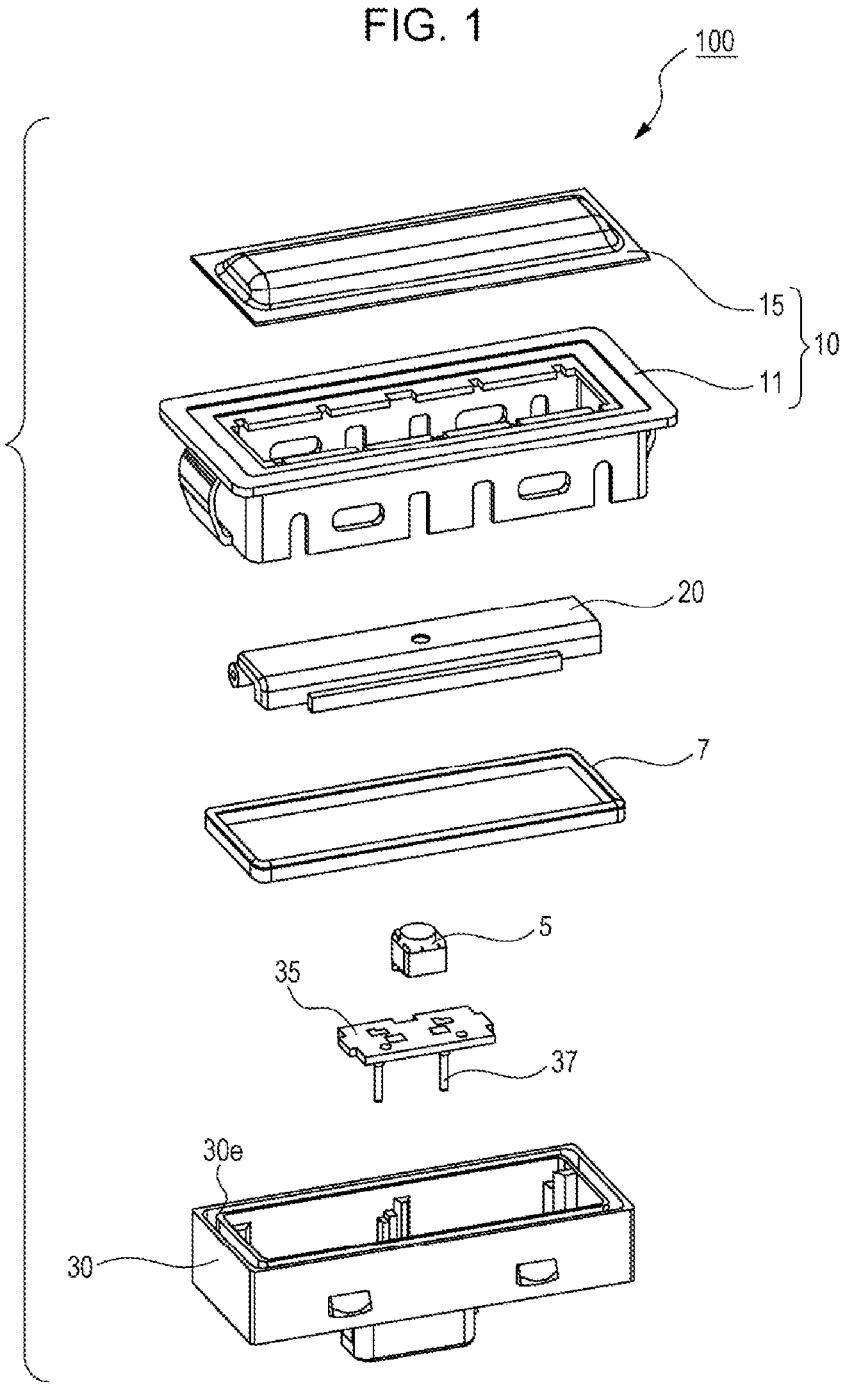
FIG. 1 is an exploded perspective view illustrating components of the switch device according to an embodiment of the present invention.

Embodiments of a switch device 100 according to the present invention will be described below with reference to the drawings. The switch device 100 is used as a switch device installed in, for example, a rear door or any of various apparatuses of a vehicle. Use of the switch device according to the present application is not limited to this and can be changed as appropriate. Herein, unless otherwise noted, the sides in the drawings are referred to as follows: the X1 side is referred to as the right side; the X2 side is referred to as the left side; the Y1 side is referred to as the rear side; the Y2 side is referred to as the front side; the Z1 side is referred to as the upper side; and the Z2 side is referred to as the lower side.

Figure 2:
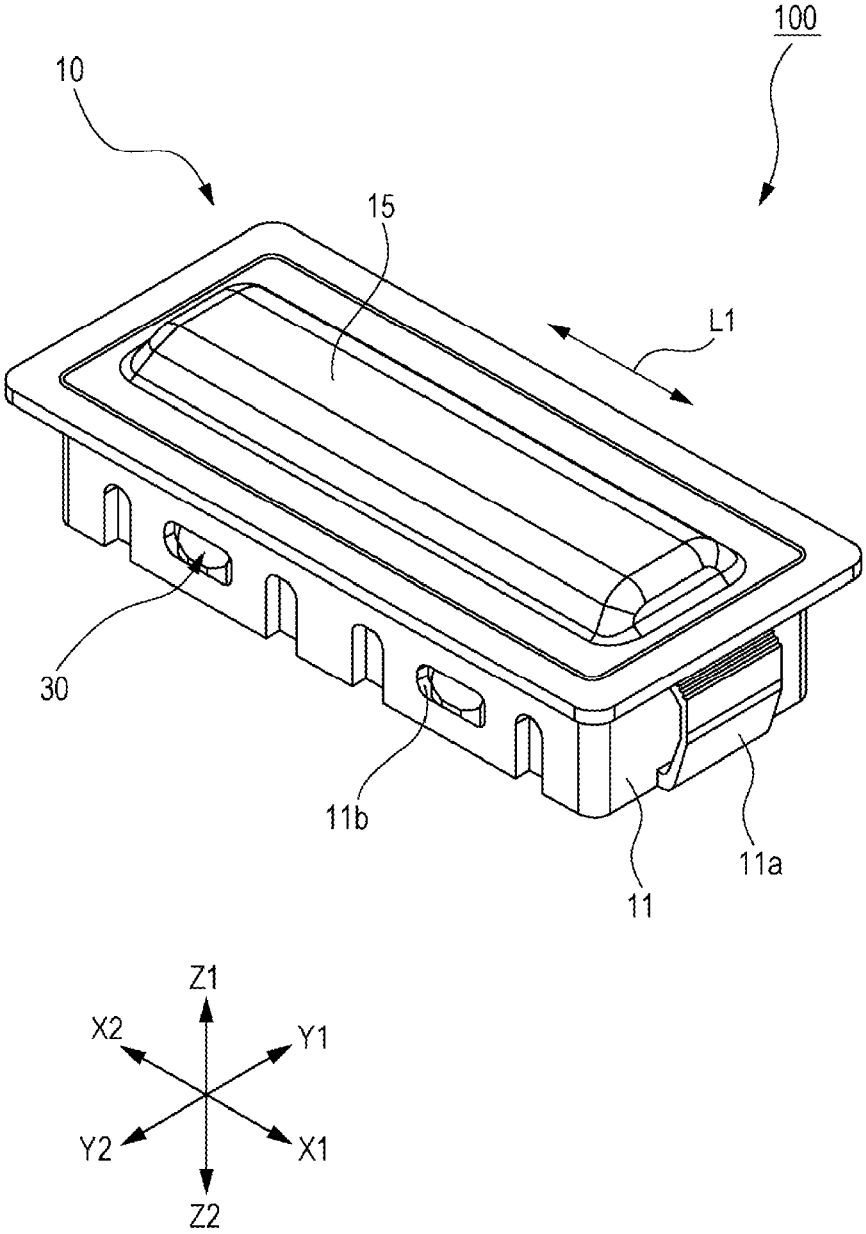
FIG. 2 is a perspective view illustrating the appearance of the switch device.
Figure 3A:
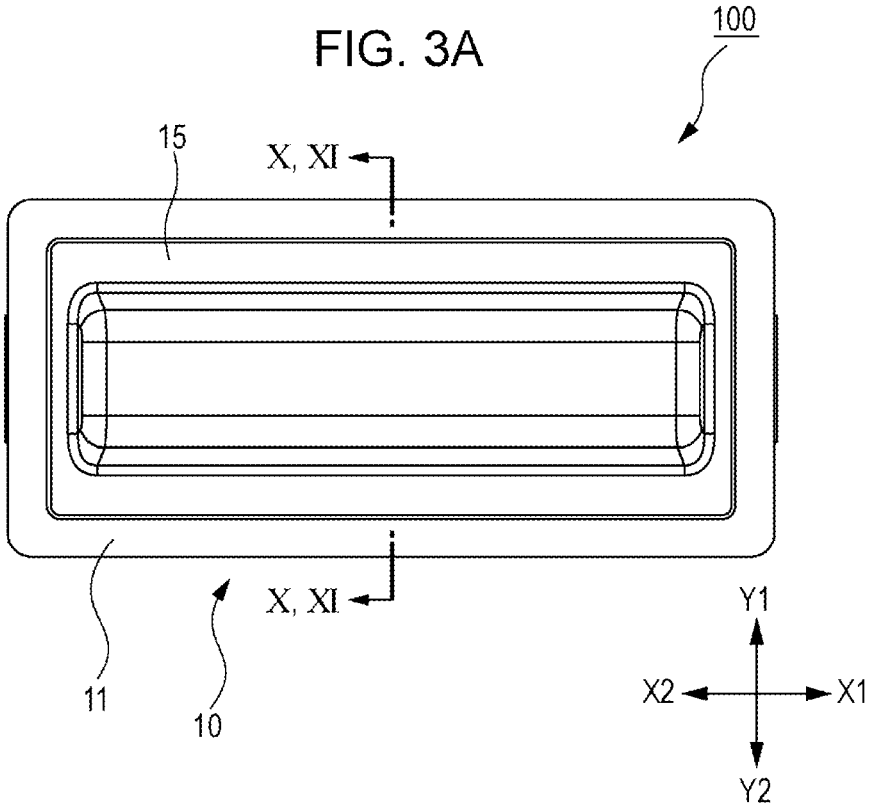
FIGS. 3A and 3B are respectively a plan view and a front view of the switch device.
Figure 3B:
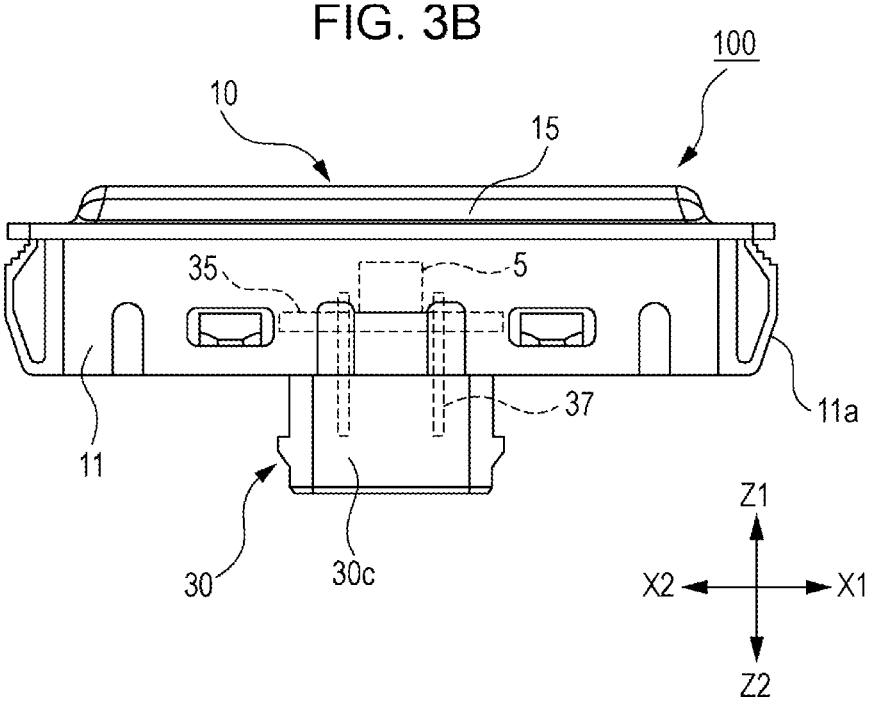
Figure 4:
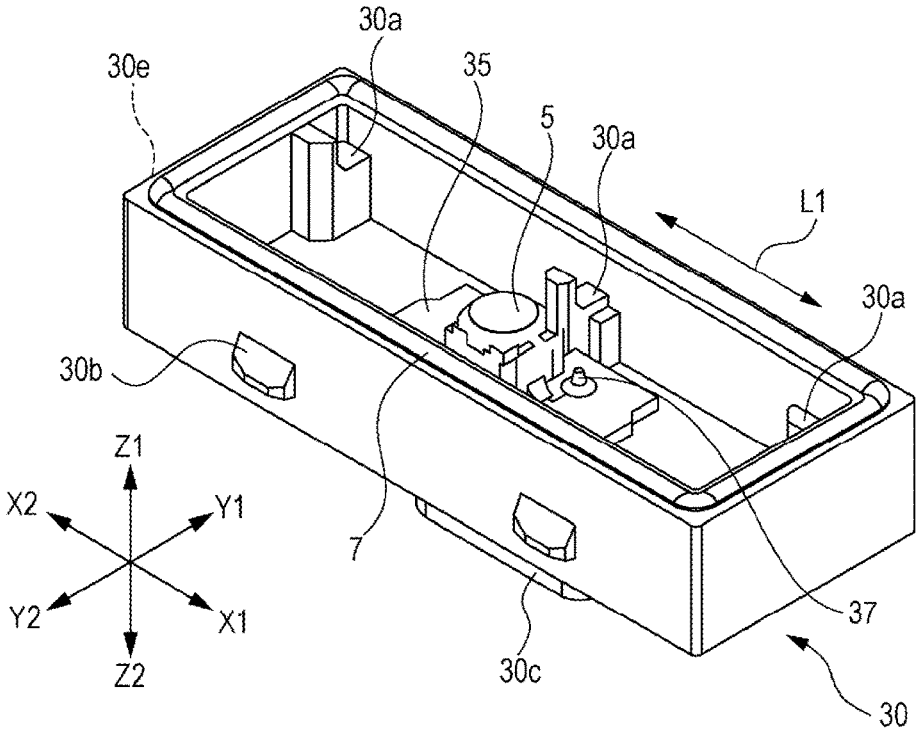
FIG. 4 is a perspective view illustrating the structure and the internal structure of the casing.

First, an overall structure of the switch device 100 is described with reference to FIGS. 1 to 4. FIG. 1 is an exploded perspective view illustrating components of the switch device 100. FIG. 2 is a perspective view illustrating the appearance of the switch device 100. FIG. 3A is a plan view of the switch device 100, and FIG. 3B is a front view of the switch device 100. FIG. 4 is a perspective view illustrating a structure of a casing 30 and an internal structure of the casing 30.

As illustrated in FIG. 1, the switch device 100 includes a covering member 10 that includes an operating portion 15 and a base portion 11, a drive member 20, a sealing member 7, a switch 5, a board 35, connecting terminals 37, and the casing 30.

As illustrated in FIGS. 2, 3A, and 3B, the switch device 100 in which the covering member 10 is mounted on the upper side of the casing 30 has a substantially parallelepiped shape elongated in the left-right direction.

Preferably, the base portion 11 and the operating portion 15 of the covering member 10 are integrally formed with each other. The base portion 11 has a substantially parallelepiped shape. The operating portion 15 is disposed on the upper side of the base portion 11. As illustrated in FIG. 3B, the operating portion 15 has a central portion in the front-rear direction that projects upward. The structure of the covering member 10 in which the base portion 11 and the operating portion 15 are integrally formed with each other will be described in detail later.

As illustrated in FIG. 4, also the casing 30 has a substantially parallelepiped shape and is formed of a synthetic resin material. The size of the casing 30 is smaller than that of the base portion 11 of the covering member 10. The covering member 10 is secured to the casing 30. A groove 30*e* illustrated in FIG. 1 is provided in upper ends of four walls that define the contour of the casing 30 in the front-rear direction and the left-right direction. The groove 30*e* has a loop shape.

As illustrated in FIG. 2, the base portion 11 of the covering member 10 preferably has a plurality of engagement portions 11*b* defined by through holes, and, as illustrated in FIG. 4, the casing 30 has a plurality of engagement projections 30*b*. As illustrated in FIG. 2, the covering member 10 and the casing 30 are preferably engaged with each other by the engagement portions 11*b* and the engagement projections 30*b*. That is, the casing 30 and the base portion 11 are preferably engaged with each other at a plurality of positions spaced from one another in an axial direction L1 of a shaft portion 21 to be described later.

Furthermore, as illustrated in FIGS. 2 and 3B, device attachment arms 11*a* are provided on the left and right sides of the base portion 11. The device attachment arms 11*a* have elasticity so that the casing 30 is easily mounted and reliably secured when the switch device 100 is attached to, for example, an apparatus in the vehicle.

As illustrated in FIGS. 3B and 4, the board 35 is mounted inside the casing 30. The switch 5 and two connecting terminals 37 are mounted on the board 35. A switching mechanism is disposed in the switch 5 so as to allow a switch circuit (not illustrated) formed by a pair of portions of a conductive pattern formed on the board 35 to be switched on and off when the covering member 10 is pressed.

A plug portion 30*c* is provided on the lower side of the casing 30. The two connecting terminals 37 mounted on the board 35 project downward from the board 35 in the plug portion 30*c*. In an apparatus in the vehicle to which the switch device 100 is attached, the plug portion 30*c* is connected to, through the two connecting terminals 37 of the switch circuit on the board 35, to a circuit provided in the apparatus in the vehicle.

As has been described, the groove 30*e* is formed in the upper ends of the four walls that define the contour of the casing 30 in the front-rear direction and the left-right direction. As illustrated in FIG. 4, the loop-shaped sealing member 7 formed to be smaller in size than the casing 30 is mounted in the groove 30*e*. The periphery of the lower surface of the base portion 11 faces upper end surfaces of the four walls defining the contour of the casing 30 in the front-rear direction and the left-right direction. Thus, when the casing 30 and the covering member 10 are combined with each other, the upper and lower surfaces of the sealing member 7 are preferably disposed between the lower surface of the base portion 11 and the upper end surfaces of the four walls (an inner bottom surface of the groove 30*e*) of the casing 30.

Next, referring to FIGS. 4 to 9B, structures of the drive member 20 and the covering member 10, a structure in which the drive member 20 and the covering member 10 are combined with each other, and a structure with which the covering member 10 is mounted on the casing 30 are described.

Figure 5:
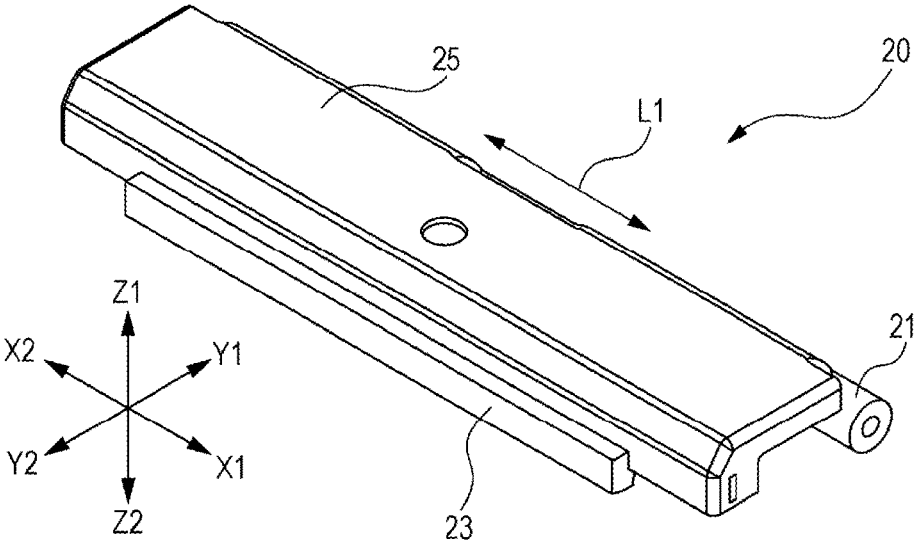
FIG. 5 is a perspective view illustrating the structure of a drive member.
Figure 6A:
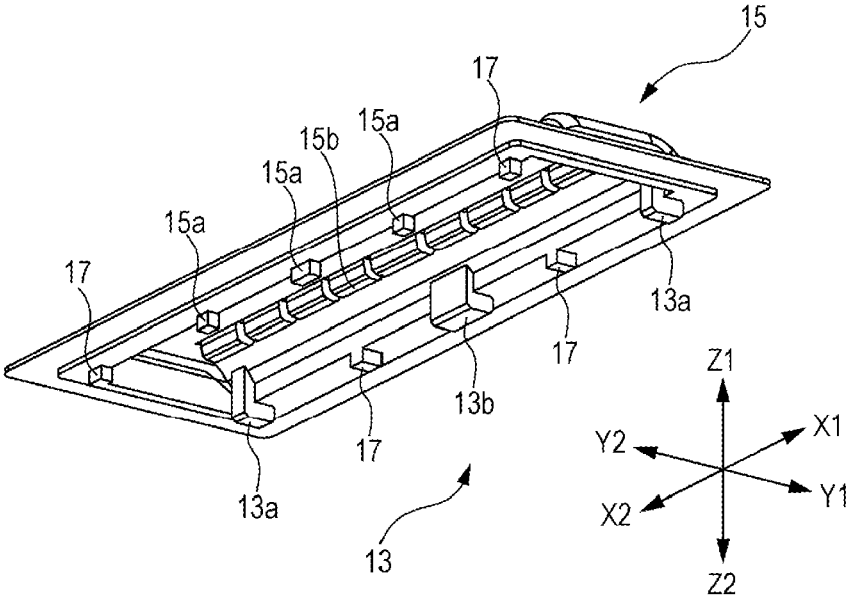
FIGS. 6A and 6B are perspective views respectively illustrating the structures of an operating portion of a covering member and a base portion of the covering member.
Figure 6B:
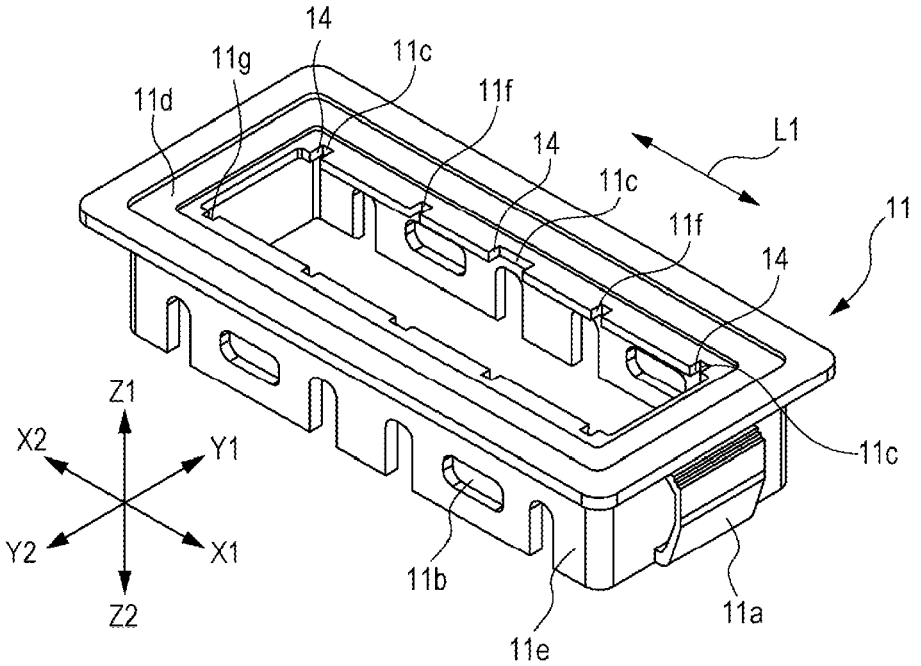
Figure 7:
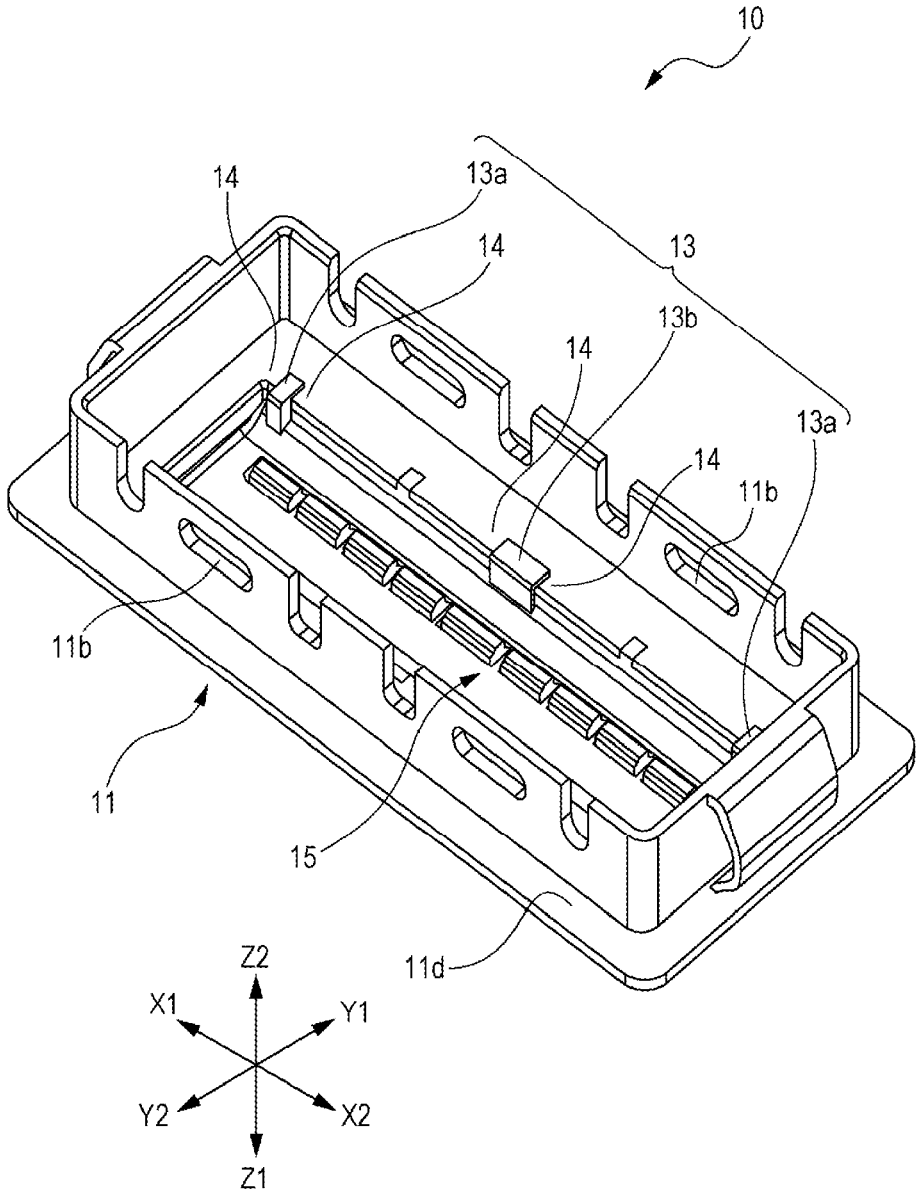
FIG. 7 is a perspective view of the covering member formed by integrating the operating portion and the base portion with each other.
Figure 8A:
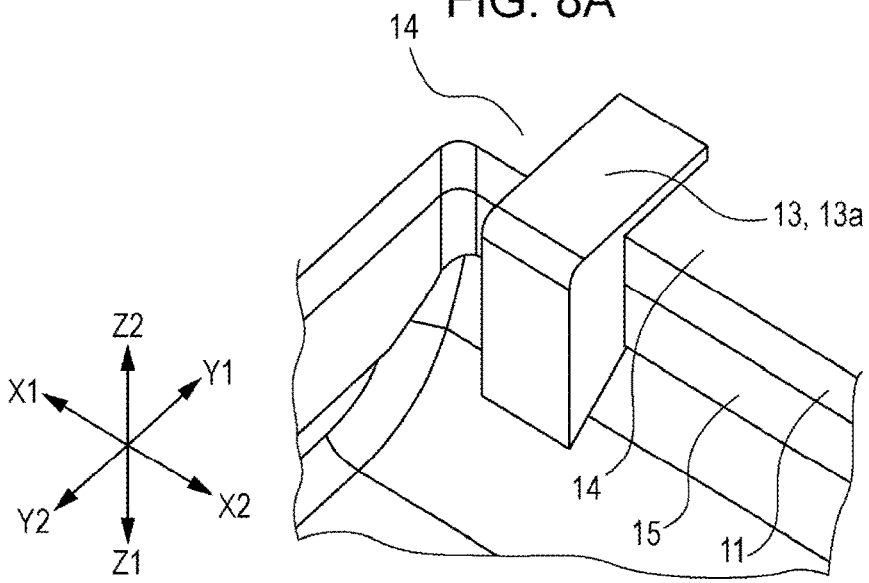
FIGS. 8A and 8B are enlarged perspective views of one of first pressing portions and a second pressing portion of the covering member.
Figure 8B:
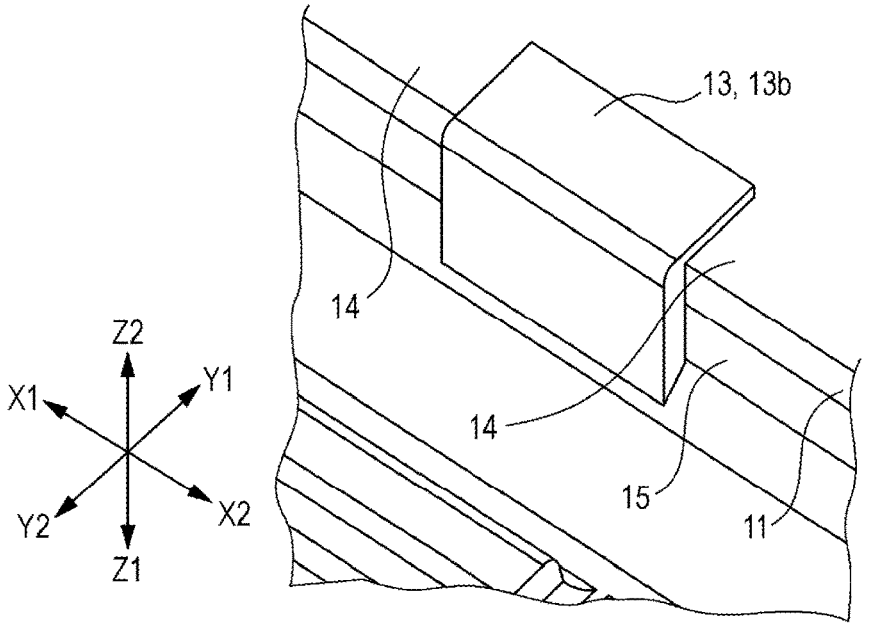
Figure 9A:
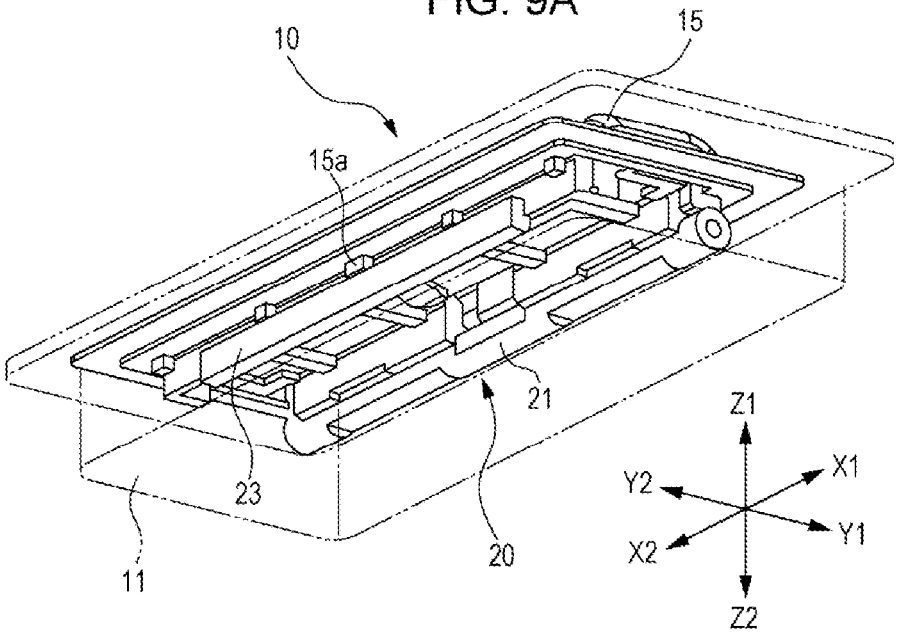
FIGS. 9A and 9B are perspective views illustrating the drive member and the covering member combined with each other.

FIG. 5 is a perspective view of the drive member 20 seen in the upper right front direction. FIG. 6A is a perspective view of the operating portion 15 of the covering member 10 seen in the lower right front direction, and FIG. 6B is a perspective view of the base portion 11 of the covering member 10 seen in the upper right front direction. FIG. 7 is a perspective view of the covering member 10 in which the operating portion 15 and the base portion 11 are integrally formed with each other seen in the lower left front direction. FIG. 8A is an enlarged perspective view of one of first pressing portions 13*a* of the covering member 10, and FIG. 8B is an enlarged perspective view of a second pressing portion 13*b*. FIG. 9A is a perspective view of the drive member 20 and the covering member 10 combined with each other seen in the lower right front direction, and FIG. 9B is a perspective view of the drive member 20 and the covering member 10 combined with each other seen in the lower right rear direction.

Figure 9B:
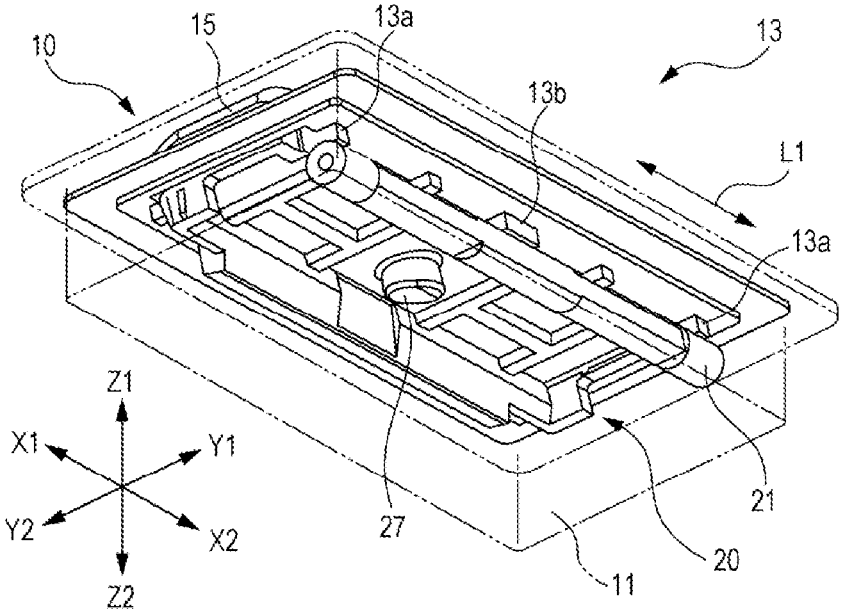

For clearly illustrating the structures of the drive member 20 and the operating portion 15 of the covering member 10, the base portion 11 of the covering member 10 is drawn as a transparent portion and indicated by a dashed two-dot line in FIGS. 9A and 9B.

As illustrated in FIG. 5, preferably, the drive member 20 has an elongated shape the longitudinal direction of which extends in the axial direction L1. The drive member 20 is formed of a synthetic resin material and includes a drive-member main body 25 and the shaft portion 21. Also, the drive member 20 preferably includes a projection 23. The drive member 20 is rotatable about the shaft portion 21.

The drive-member main body 25 of the drive member 20 has a substantially rectangular shape in plan view. The shaft portion 21 has a cylinder shape the longitudinal direction of which extends in the axial direction L1. The shaft portion 21 is provided along the side on the rear side (Y1 side) of the drive-member main body 25. The projection 23 has a substantially elongated box shape the longitudinal direction of which extends in the axial direction L1. The shaft portion 21 is provided along the side on the front side (Y2 side) of the drive-member main body 25 and outwardly projects to the side facing the shaft portion 21.

As illustrated in FIG. 4, the casing 30 has bearing portions 30*a*. The bearing portions 30*a* each have a recessed shape. The bearing portions 30*a* are provided at a plurality of positions (three positions according to the present embodiment) spaced from one another in the axial direction L1. The shaft portion 21 of the drive member 20 is disposed in these bearing portions 30*a*.

As illustrated in FIGS. 6A and 6B, the covering member 10 includes the operating portion 15 formed of a elastically deformable elastic material and the base portion 11 that is formed of a synthetic resin material, secured to the casing 30, and integrated with the operating portion 15. For ease of understanding, the operating portion 15 and the base portion 11 are separately illustrated in FIGS. 6A and 6B. However, actually, the operating portion 15 and the base portion 11 are integrated with each other as the covering member 10 as illustrated in FIG. 7.

That is, preferably, the operating portion 15 formed of an elastic material is integrated with the base portion 11 formed of a synthetic resin material by two-color molding. In the two-color molding, the base portion 11 of the synthetic resin material is initially formed, and then, the operating portion 15 of the elastic material is integrally formed.

As illustrated in FIG. 6A, a pressing projection 15*b* that faces an upper surface of the drive member 20 is preferably formed in the operating portion 15 of the covering member 10. Preferably, the pressing projection 15*b* extends in the longitudinal direction (X1-X2 direction) of the operating portion 15 and is separated into a plurality of portions with gaps between the portions. The pressing projection 15*b* is shifted from the center of the operating portion 15 in the front-rear direction toward the rear side (Y1 side).

Furthermore, as illustrated in FIG. 6A, the operating portion 15 preferably includes a plurality of abutting portions 15*a* that can abut the projection 23 of the drive member 20. The abutting portions 15*a* are disposed further to the front side (Y2 side) than the central position of the operating portion 15 in the front-rear direction. The plurality of abutting portions 15*a* are, similarly to the portions of the pressing projection 15*b*, formed in the longitudinal direction of the operating portion 15 with gaps therebetween.

As illustrated in FIGS. 9A and 9B, the covering member 10 faces the drive member 20 such that the covering member 10 can press the drive member 20. The drive member 20 includes a pressing portion 27 at a central portion thereof. When the switch device 100 is pressed, the pressing portion 27 presses the switch 5 of FIG. 4.

The base portion 11 formed of a synthetic resin material includes, as illustrated in FIG. 6B, a housing portion 11*e* and a flange portion 11*d*. The housing portion 11*e* has a substantially rectangular shape having the long side extending in the axial direction L1 in plan view. The flange portion 11*d* is provided on the upper side of the housing portion 11*e*. The flange portion 11*d* projects in the front-rear direction and the left-right direction at upper ends of the housing portion 11*e* and has a three-step structure.

Among the three steps of the flange portion 11*d* of the base portion 11, part of an innermost step on the rear side (Y1 side) of the flange portion 11*d* has a plurality of recesses 11*c* and a plurality of recesses 11*f*. Also, part of an innermost step on the front side (Y2 side) of the flange portion 11*d* has a plurality of recesses 11*g*. The above-described device attachment arms 11*a* are provided at two short sides of the housing portion 11*e*, and the plurality of engagement portions 11*b* are provided at the two long sides of the housing portion 11*e*.

As illustrated in FIG. 7, an outermost step of the flange portion 11*d* projects further to the outside than the outside shape of the operating portion 15 when the base portion 11 and the operating portion 15 are integrated with each other by the two-color molding. Furthermore, the innermost step of the flange portion 11*d* projects to the inside of the operating portion 15 when the base portion 11 and the operating portion 15 are integrated with each other. Outermost portions of the four sides of the operating portion 15 are positioned on a central step of the flange portion 11*d* illustrated in FIG. 6B. That is, when the base portion 11 and the operating portion 15 are formed by two-color molding, the integration is performed while the operating portion 15 is placed on a central portion of the flange portion 11*d*.

As illustrated in FIG. 6A, a pressing structure 13 is formed in the operating portion 15 so as to press an upper portion of the shaft portion 21 of the drive member 20. The pressing structure 13 is integrated with the base portion 11 and formed of an elastically deformable elastic material. Furthermore, the pressing structure 13 is preferably integrally formed with the operating portion 15 formed of an elastically deformable elastic material. The pressing structure 13 projects downward from a lower surface of the operating portion 15.

As illustrated in FIGS. 6A and 7, the pressing structure 13 preferably includes the first pressing portions 13*a* and the second pressing portion 13*b*. The first pressing portions 13*a* are positioned at sides corresponding to both end portions in the longitudinal direction of the drive member 20. The second pressing portion 13*b* is positioned between two of the first pressing portions 13*a*. That is, the pressing structure 13 includes the portions thereof provided at the plurality of positions spaced from one another in the axial direction L1 of the shaft portion 21 of the drive member 20. Accordingly, as illustrated in FIG. 9B, the shaft portion 21 of the drive member 20 extending in the axial direction L1 is pressed at the plurality of positions by the pressing structure 13. The width of the second pressing portion 13*b* is larger than the width of the first pressing portions 13*a* in the left-right direction.

As illustrated in FIG. 6B, the plurality of recesses 11*c* are formed (at three positions) in the inward-projecting step of the flange portion 11*d* of the base portion 11 as described above. The recesses 11*c* disposed at three positions correspond to the first pressing portions 13*a* and the second pressing portion 13*b* of FIG. 6A.

The recesses 11*c* at the three positions are each formed by rear, left, and right walls formed in the flange portion 11*d* of the base portion 11. The left and right walls that form the recesses 11*c* preferably serve as regulating portions 14 which regulate the first pressing portions 13*a* and the second pressing portion 13*b*.

In other words, as illustrated in FIGS. 7, 8A and 8B, both sides of each of the first pressing portions 13*a* and the second pressing portion 13*b* of the pressing structure 13 are adjacent to the regulating portions 14 formed of a synthetic resin material. Accordingly, the pressing structure 13 formed of an elastically deformable elastic material as is the case with the operating portion 15 is supported by the regulating portions 14 formed of a synthetic resin material from both the sides (in the left-right direction).

When the covering member 10 is mounted on the casing 30, the pressing structure 13 may be excessively elastically deformed. In this case, the function of pressing the shaft portion 21 of the drive member 20 may be degraded. In order to address this, the regulating portions 14 regulate the pressing structure 13 so that the pressing structure 13 is not deformed more than required.

When the switch device 100 has been assembled, the pressing structure 13 including the first pressing portions 13*a* and the second pressing portion 13*b* preferably project from a surface of the base portion 11 on the Z2 side near the regulating portions 14 toward the shaft portion 21 side of the drive member 20 as illustrated in FIGS. 8A and 8B and preferably abut the shaft portion 21 at the plurality of positions as illustrated in FIG. 9B. In this state, the pressing structure 13 is elastically deformed. Thus, the pressing structure 13 elastically abuts the shaft portion 21 at each of the positions so as to suppress play of the shaft portion 21 disposed in the bearing portions 30*a*.

As illustrated in FIG. 6A, the operating portion 15 of the covering member 10 includes projections 17 at positions between the first pressing portions 13*a* and the second pressing portion 13*b* on the Y1 side of the operating portion 15 and at two positions, that is, at leftmost and rightmost positions, on the front side (Y2 side) of the operating portion 15. Furthermore, as has been described, in the base portion 11 illustrated in FIG. 6B, the recesses 11*f* are formed at two positions in the part of the innermost step on the rear side (Y1 side) of the flange portion 11*d*, and the recesses 11*g* are formed at two positions, that is, at leftmost and rightmost positions, in the part of the inner most step on the front side (Y2 side) of the flange portion 11*d*. The recesses 11*f* and the recesses 11*g* do not extend from a surface of the base portion 11 on the Z2 side near the regulating portions 14 to the drive member 20 side.

When the operating portion 15 and the base portion 11 are formed by the two-color molding, the recesses 11*f* and the recesses 11*g* are engaged with the projections 17 of the operating portion 15. The engagement of the recesses 11*f* and the recesses 11*g* with the projections 17 increases the degree of adherence between the operating portion 15 and the base portion 11.

As illustrated in FIG. 9A, the projection 23 of the above-described drive member 20 projects outward on the side facing the shaft portion 21. Furthermore, as has been described, the operating portion 15 includes the abutting portions 15*a* that can abut the projection 23 of the drive member 20. When the switch device 100 has been assembled, the projection 23 of the drive member 20 abuts the abutting portions 15*a* of the operating portion 15. Thus, as is the case with the pressing structure 13, the abutting portions 15*a* also project downward (Z2 side) from the surface of the flange portion 11*d* of the base portion 11 on the Z2 side.

Furthermore, as illustrated in FIG. 7, the base portion 11 of the covering member 10 includes the plurality of engagement portions 11*b* as has been described at positions between the first pressing portions 13*a* and the second pressing portion 13*b*. The casing 30 and the base portion 11 are engaged with each other by the engagement portions 11*b* and the engagement projections 30*b* of the casing 30 illustrated in FIG. 4 at the plurality of positions spaced from one another in the axial direction L1.

Figure 10:
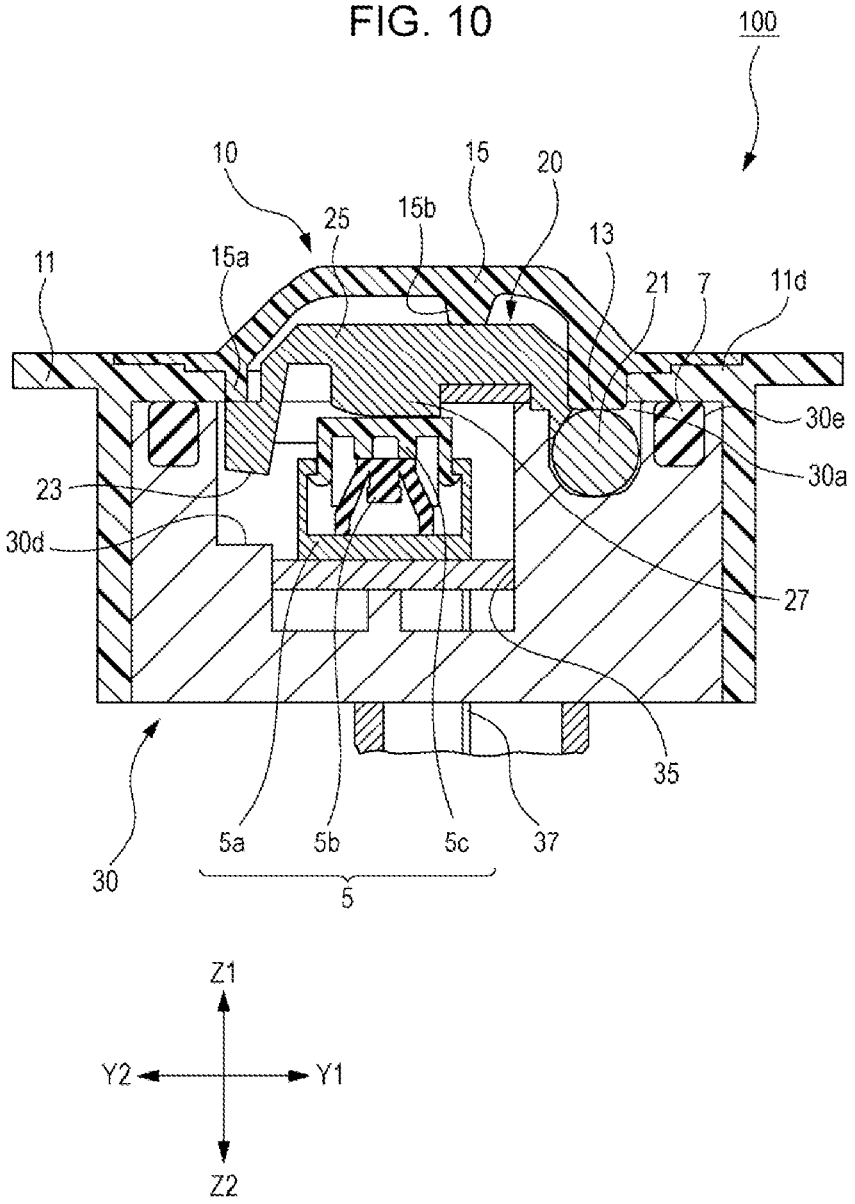
FIG. 10 is a sectional view illustrating the switch device before the switch device is operated.

Next, an overall structure of the switch device 100 is described with reference to FIGS. 4 and 10. FIG. 10 is a sectional view illustrating the structure of the switch device 100 taken along line X, XI-X, XI of FIG. 3A. FIG. 10 illustrates the switch device 100 in a state before the switch device 100 is operated.

As illustrated in FIG. 10, the sealing member 7 in the groove 30*e* is disposed between the base portion 11 of the covering member 10 and the casing 30. The sealing member 7 has a loop shape as illustrated in FIG. 4. Accordingly, the sealing member 7 is disposed on the four sides of the contour of the casing 30 having a substantially rectangular shape in plan view.

As has been described, the switch 5 is placed on and secured to the board 35 mounted in the casing 30. Furthermore, the connecting terminals 37 are mounted on the lower side of the board 35 so as to be oriented downward. As illustrated in FIG. 10, the switch 5 includes a switch casing 5*a*, a rubber dome 5*b*, a slide portion 5*c*, and a pair of fixed contacts (not illustrated). The switch casing 5*a* and the slide portion 5*c* are each formed of a synthetic resin material, and the rubber dome 5*b* is formed of an elastic material. A moving contact (not illustrated) is formed of an electrically conductive material on a lower surface of the rubber dome 5*b*. This switch 5 is a push switch in which the pair of fixed contacts are electrically connected to each other through the moving contact when the slide portion 5*c* serving as an operating portion is pressed inward in the switch casing 5*a*.

The shaft portion 21 of the drive member 20 is disposed in the recessed bearing portions 30*a* in the casing 30. Furthermore, the drive member 20 is placed on the upper side of the switch 5, and the pressing portion 27 of the drive member 20 abuts the slide portion 5*c* of the switch 5. The switch 5 is driven by the drive member 20.

The operating portion 15 being part of the covering member 10 is disposed on the upper side of the drive member 20 so as to face the drive member 20. The pressing projection 15*b* of the operating portion 15 abuts an upper surface of the drive-member main body 25 of the drive member 20. Furthermore, in an initial state, that is, before the drive member 20 is operated, the projection 23 of the drive member 20 preferably abuts the abutting portions 15*a* of the operating portion 15. A step portion 30*d* is formed at a position of the casing 30 that faces a lower surface of the projection 23.

The pressing structure 13, which is part of the covering member 10 and formed of an elastic material, is disposed on the upper side of the shaft portion 21 of the drive member 20 formed of a synthetic resin material and abuts the upper portion of the shaft portion 21. Here, when the switch device 100 has been assembled, the pressing structure 13 abuts the shaft portion 21 so as to be elastically deformed. Thus, the pressing structure 13 constantly elastically abuts the shaft portion 21.

Figure 11:
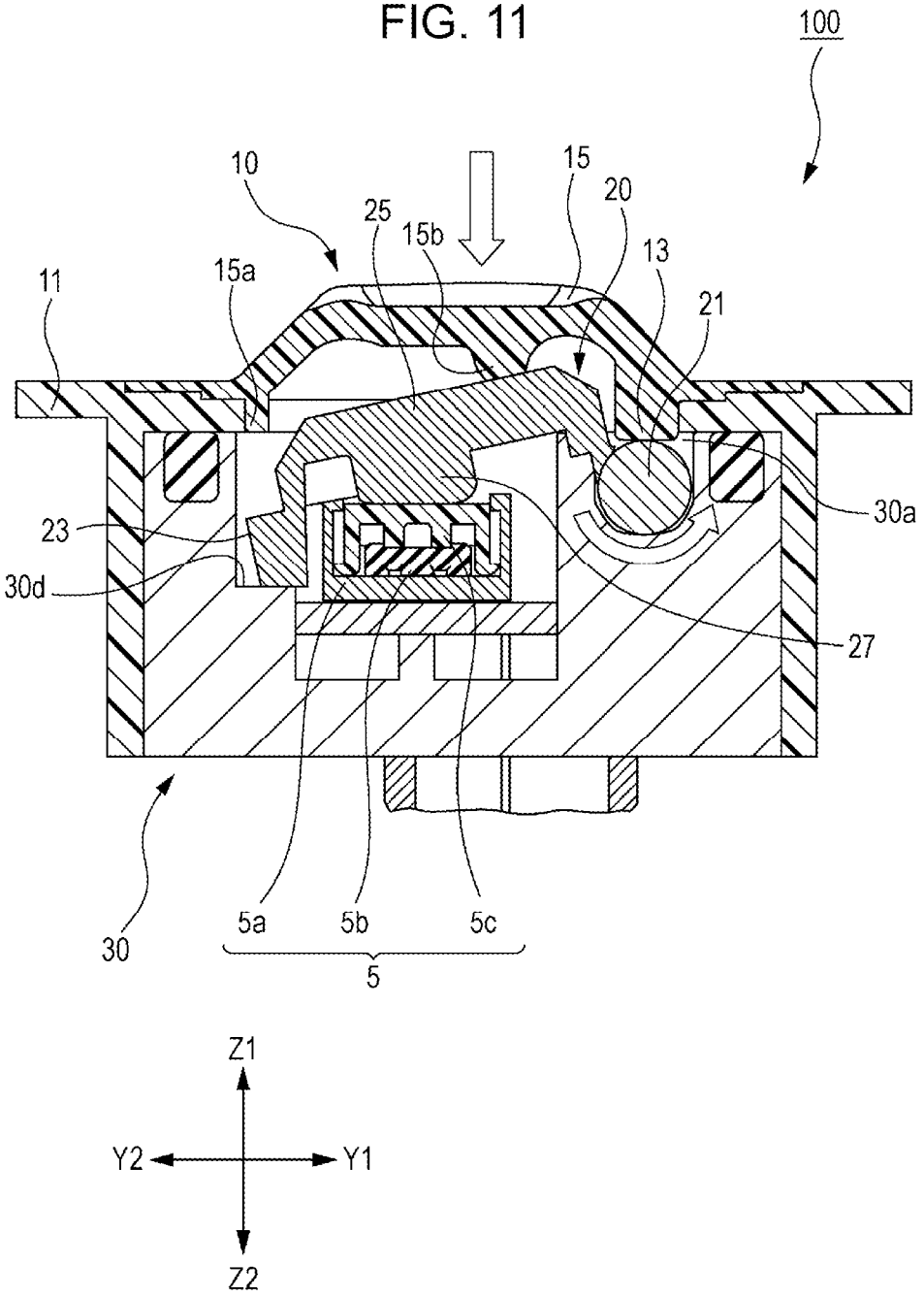
FIG. 11 is a sectional view illustrating the switch device after the switch device is operated.
Figure 12:
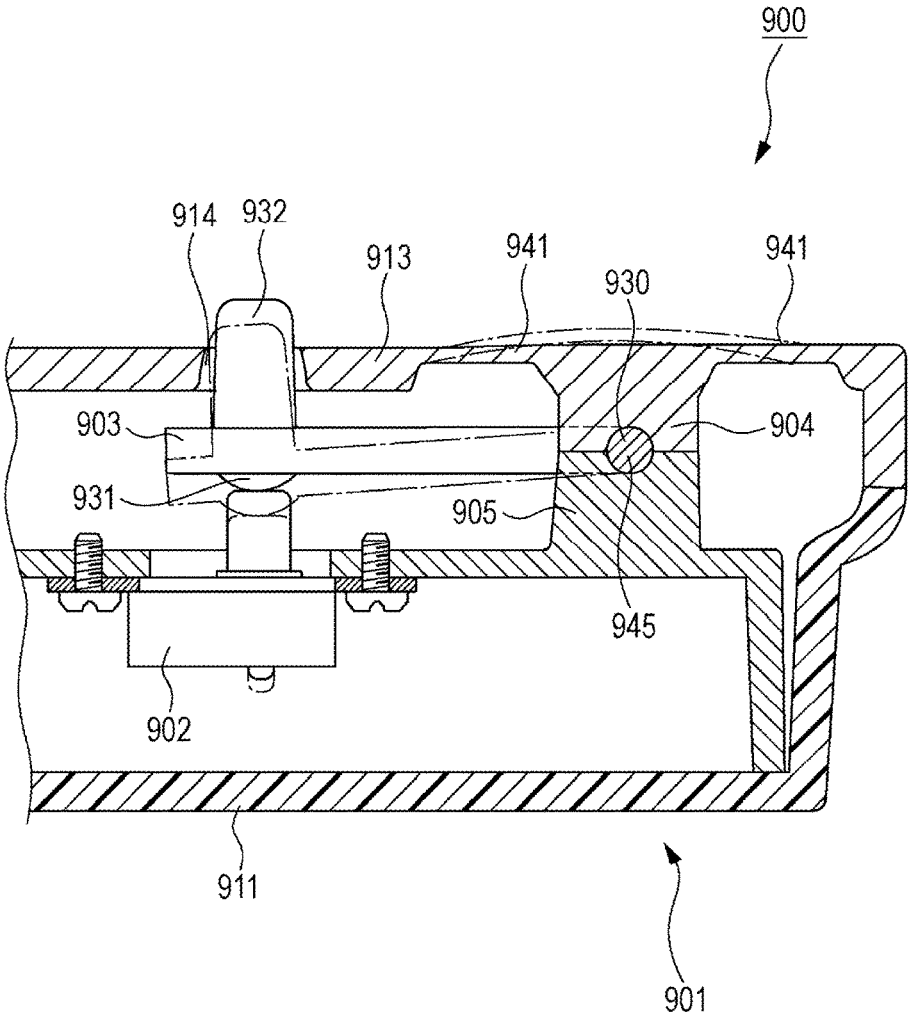
FIG. 12 PRIOR ART
FIG. 12 is a sectional view illustrating the structure of a related-art switch device.

Next, operation of the switch device 100 is described with reference to FIGS. 10 and 11. FIG. 11 is a sectional view of the switch device 100 taken along line X, XI-X, XI of FIG. 3A illustrating a state after the switch device 100 is pressed. FIG. 10 illustrates the switch device 100 in a state in which the pressing of the switch device 100 is released.

In order to operate the switch device 100, an upper surface of the operating portion 15 of the covering member 10 is pressed as illustrated in FIG. 11. When the operating portion 15 formed of an elastic material is pressed, the operating portion 15 is elastically deformed, and the pressing projection 15*b* presses the upper surface of the drive-member main body 25 of the drive member 20 formed of a synthetic resin material.

When the upper surface of the drive-member main body 25 is pressed, the shaft portion 21 of the drive member 20 is rotated (counterclockwise in FIG. 11). As a result, the pressing portion 27 presses an upper surface of the slide portion 5*c* of the switch 5 formed of a synthetic resin material. The slide portion 5*c* presses the rubber dome 5*b* formed of an elastic material, thereby causing the rubber dome 5*b* to be elastically deformed such that the rubber dome 5*b* is compressed in the up-down direction. As a result, the moving contact is brought into contact with the fixed contacts to drive the switch 5. Along with the deformation of the rubber dome 5*b*, a clicking sensation is produced. Thus, an operator who operates the switch device 100 can feel the clicking sensation.

At this time, the upper portion of the shaft portion 21 of the drive member 20 is pressed while being urged by the pressing structure 13 in the bearing portions 30*a* of the casing 30. Since the pressing structure 13 is formed of an elastic material, the shaft portion 21 is rotated without play when the operating portion 15 is pressed. Accordingly, a preferable operating sensation can be obtained, and noise due to the play can be prevented.

When the operating portion 15 of the covering member 10 is pressed, an upper surface of the projection 23 of the drive member 20 is separated from the abutting portions 15*a* of the operating portion 15. After that, the lower surface of the projection 23 abuts an upper surface of the step portion 30*d* of the casing 30. This abutment of the projection 23 with the step portion 30*d* of the casing 30 regulates the pressing of the operating portion 15.

Next, by releasing the pressing of the operating portion 15, as illustrated in FIG. 10, the shape of the rubber dome 5*b* of the switch 5 is returned to the original shape, the shaft portion 21 is rotated in the opposite direction to the direction in which the shaft portion 21 is rotated due to the pressing of the operating portion 15, and the drive member 20 is returned to the original position. At the same time, the lower surface of the projection 23 of the drive member 20 is separated from the upper surface of the step portion 30*d* of the casing 30, and the upper surface of the projection 23 abuts the abutting portions 15*a* of the operating portion 15 formed of an elastic material. Along with these, the shape of the operating portion 15 having been elastically deformed is returned to the original shape, that is, the operating portion 15 is returned to the same shape as that in the initial state.

Effects produced according to the present embodiment are described below.

Since the pressing structure 13 of the switch device 100 that presses the shaft portion 21 is formed of an elastic material, the pressing structure 13 is elastically deformable. Accordingly, the switch device 100 unlikely to be damaged even when a large force is applied to the pressing structure 13 can be obtained.

Furthermore, since the pressing structure 13 and the operating portion 15 are integrally formed with each other, handling is facilitated. Also, since the pressing structure 13 does not drop, faulty operation caused by the drive member 20 is prevented.

Furthermore, since the pressing structure 13 that presses the shaft portion 21 includes the portions (the first pressing portions 13*a* and the second pressing portion 13*b*) provided at the plurality of positions, rotation of the drive member 20 can be stabilized.

Furthermore, since the regulating portions 14 formed of a synthetic resin material are provided on both the sides of each of the first pressing portions 13*a* and the second pressing portion 13*b* of the pressing structure 13, the shaft portion 21 can be appropriately pressed when the pressing structure 13 is elastically deformed by the shaft portion 21.

Furthermore, since the casing 30 and the base portion 11 are engaged with each other at the plurality of positions, the switch 5 can be reliably driven even when the end portions of the drive member 20 are pressed.

Furthermore, since the second pressing portion 13*b* is positioned between the engagement portions 11*b*, the shaft portion 21 that faces the second pressing portion 13*b* can be reliably pressed, and accordingly, play can be prevented from existing.

Furthermore, the abutting portions 15*a*, with which the projection 23 abuts when the drive member 20 is returned, are formed of an elastic material. Thus, the sound generated by the abutment can be reduced.

Furthermore, the pressing projection 15*b* is separated into the plurality of portions with the gaps between the portions. This increases the independence of the operating portion 15 formed of an elastic material when the operating portion 15 is pressed. Accordingly, sensations such as the clicking sensation obtained from the switch 5 can be easily transmitted to the operator.

Furthermore, the operating portion 15 formed of an elastic material can be reliably integrated with the base portion 11 by the two-color molding. Thus, removal of the operating portion 15 from the base portion 11 can be prevented even when the operating portion 15 is elastically deformed.

Furthermore, since the sealing member 7 exists between the base portion 11 and the casing 30, the casing 30 can be made watertight.

As has been described, since the pressing structure of the switch device according to the present invention that presses the shaft portion is formed of an elastic material, the pressing structure is elastically deformable. Accordingly, the pressing structure unlikely to be damaged even when a large force is applied to the pressing structure can be obtained.

In should be understood that the present invention is not limited to the above-described embodiment and can be modified in a variety of manners without departing from the gist of the present invention.

What is claimed is:

1. A switch device comprising:

a casing that includes a recessed bearing portion;

a rotatable drive member that includes a shaft portion disposed in the bearing portion;

a switch driven by the drive member; and a covering member that includes a pressing structure provided so as to press an upper portion of the shaft portion and that is secured to the casing;

wherein the covering member includes:

an operating portion that faces the drive member such that the operating portion is able to press the drive member and that is formed of an elastically deformable elastic material; and a base portion that is secured to the casing, that is comprised of a synthetic resin material, and that is integrated with the operating portion, and wherein the pressing structure is integrated with the base portion and comprises an elastically deformable elastic material;

wherein regulating portions comprising a synthetic resin material are provided adjacent to both sides of each of the plurality of pressing portions; and wherein the pressing structure projects from the regulating portions toward the shaft portion and abuts the shaft portion.

2. The switch device according to claim 1, wherein the pressing structure is integrally formed with the operating portion.

3. The switch device according to claim 2, wherein the pressing structure includes a plurality of pressing portions provided at a plurality of positions spaced from one another in an axial direction of the shaft portion.

4. The switch device according to claim 1, wherein the pressing structure includes a plurality of pressing portions provided at a plurality of positions spaced from one another in an axial direction of the shaft portion.

5. The switch device according to claim 4, wherein a long side of the drive member extends in the axial direction, wherein the pressing structure includes:

first pressing portions disposed at positions corresponding to both end portions in a longitudinal direction of the drive member, and a second pressing portion positioned between the first pressing portions, and wherein the casing and the base portion are engaged with each other at a plurality of positions spaced from one another in the axial direction.

6. The switch device according to claim 5,
wherein the covering member has a plurality of engagement portions at positions between the first pressing portions and the second pressing portion, and
wherein the casing and the base portion are engaged with each other by the engagement portions.

7. The switch device according to claim 1,
wherein the drive member includes a projection that projects outward to a side facing the shaft portion,
wherein the operating portion includes an abutting portion that is able to abut the projection, and
wherein, in an initial state in which the drive member has not yet been operated, the projection abuts the abutting portion.

8. The switch device according to claim 1,
wherein a long side of the drive member extends in an axial direction of the shaft portion,
wherein the operating portion includes a pressing projection that faces an upper surface of the drive member and that extends in a longitudinal direction of the drive member, and
wherein the pressing projection is separated into a plurality of portions with gaps between the portions.

9. The switch device according to claim 1,
wherein the operating portion is integrated with the base portion by two-color molding.

10. The switch device according to claim 1,
wherein a loop-shaped sealing member is disposed between the casing and the base portion.

11. A switch device comprising:
a casing that includes a recessed bearing portion;
a rotatable drive member that includes a shaft portion disposed in the bearing portion;
a switch driven by the drive member; and
a covering member that includes a pressing structure provided so as to press an upper portion of the shaft portion and that is secured to the casing;
wherein the covering member includes:
an operating portion that faces the drive member such that the operating portion is able to press the drive member and that is formed of an elastically deformable elastic material; and
a base portion that is secured to the casing, that is comprised of a synthetic resin material, and that is integrated with the operating portion; and
wherein the pressing structure is integrated with the base portion and comprises an elastically deformable elastic material;
wherein the drive member includes a projection that projects outward to a side facing the shaft portion;
wherein the operating portion includes an abutting portion that is able to abut the projection; and
wherein, in an initial state in which the drive member has not yet been operated, the projection abuts the abutting portion.

12. A switch device comprising:
a casing that includes a recessed bearing portion;
a rotatable drive member that includes a shaft portion disposed in the bearing portion;
a switch driven by the drive member; and
a covering member that includes a pressing structure provided so as to press an upper portion of the shaft portion and that is secured to the casing;
wherein the covering member includes:
an operating portion that faces the drive member such that the operating portion is able to press the drive member and that is formed of an elastically deformable elastic material; and
a base portion that is secured to the casing, that is comprised of a synthetic resin material, and that is integrated with the operating portion;
wherein the pressing structure is integrated with the base portion and comprises an elastically deformable elastic material;
wherein a long side of the drive member extends in an axial direction of the shaft portion;
wherein the operating portion includes a pressing projection that faces an upper surface of the drive member and that extends in a longitudinal direction of the drive member; and
wherein the pressing projection is separated into a plurality of portions with gaps between the portions.

* * * * *